United States Patent [19]

Hirzel

[11] Patent Number: 5,064,058

[45] Date of Patent: Nov. 12, 1991

[54] LIQUID DISPENSER FOR APPLICATOR

[76] Inventor: Suzy C. Hirzel, 933 Shellwood Way, Sacramento, Calif. 95831

[21] Appl. No.: 296,064

[22] Filed: Jan. 12, 1989

[51] Int. Cl.[5] ..... A46B 17/00; B65D 81/24

[52] U.S. Cl. ..... 206/209; 132/317; 206/229; 401/123

[58] Field of Search ..... 206/15.3, 205, 207, 206/209, 210, 229, 361, 362, 581, 823; 15/104.94, 142, 118, 230.11, 244.1, 244.2, 257.05; 401/6, 123–126, 129–131, 118–119, 197; 132/313, 317, 318

[56] References Cited

U.S. PATENT DOCUMENTS

| | | | |
|---|---|---|---|
| 982,232 | 1/1911 | Bartholomew | 14/244.1 |
| 1,193,433 | 8/1916 | Searcy | 401/123 |
| 2,252,551 | 8/1941 | Brollier et al. | 132/313 |
| 2,570,596 | 10/1951 | Ross | 15/244.1 X |
| 2,575,788 | 11/1951 | Bobrov | 401/131 |
| 2,829,393 | 4/1958 | Turcotte | 15/244.1 X |
| 3,060,942 | 10/1962 | Finlay | 206/229 X |
| 3,185,291 | 5/1965 | Lerner | 206/209 |
| 3,226,754 | 1/1966 | Brittain | 15/230.11 |
| 3,568,236 | 3/1971 | Aston | 15/244.1 |
| 3,837,749 | 9/1974 | Spatz | 401/130 |
| 3,850,298 | 11/1974 | Jolly | 15/257.06 X |
| 3,886,621 | 6/1975 | Welsh | 15/230.11 |
| 4,213,472 | 7/1980 | Gueret et al. | 132/313 |
| 4,620,558 | 11/1986 | Lüttgens | 132/313 |
| 4,771,501 | 9/1988 | Leiter | 206/209 X |

FOREIGN PATENT DOCUMENTS

| | | | |
|---|---|---|---|
| 59753 | 4/1912 | Switzerland | 206/209 |
| 2046596 | 11/1980 | United Kingdom | 15/230.11 |
| 2172820 | 10/1986 | United Kingdom | 15/230.11 |

*Primary Examiner*—Bryon P. Gehman

[57] ABSTRACT

An improved dispenser which has an internal storage shelf disposed above a well and opposite a sloping grid. The dispenser has a generally "V" shape appearance in side elevation and has an opening and matching lid. Also, the dispenser may have a vertical carrying handle.

3 Claims, 4 Drawing Sheets

LIQUID DISPENSER FOR APPLICATOR

BACKGROUND OF THE INVENTION

1. Field of the Invention

The present invention generally relates to liquid coating and, more particularly, to an improved type of applicator and dispenser for liquid coating application.

2. Prior Art

Liquid foundations are usually applied by hand or by flat, round triangular shaped cosmetic sponges, applicators and the like devices. Fingers are preferred as applicators because the fingers are round and smooth, giving the user greater control over the amount of areas of application of the cosmetic. However, the finger method is messy, does not apply the cosmetic evenly to the skin, and pulls the skin, leaving finger marks on the treated skin surface. Extra make-up tends to go into facial cracks and wrinkles, leaving accentuated facial lines so that the user looks older, defeating the purpose of the cosmetics. Moreover, pulling skin day after day will make the face age more rapidly.

While certain sponge applicators are useful, they usually are too large and bulky with too many sharp corners and angles, since the face being almost round and curved with no really flat surfaces, such applicators rarely provide a truly satisfactory result. Accordingly, there remains a need for an improved cosmetic applicator capable of smoothly, rapidly and evenly applying liquid cosmetics to all desired parts of the skin without stretching the skin, or otherwise providing undesired results. Such applicators should preferably be provided in several sizes and/or shapes in order to customize the applicator for the user. Preferably the applicator should be provided in a kit which includes a storage and dispensing container for the applicator and cosmetic container preventing evaporation or contamination of the cosmetic.

Also, people need, to touch up small surface areas with paint. Every time a touch up is needed, either they have to buy all the new applicators, containers and paint or try to make use of the old ones, which were usually ruined, dried out and lost after the last coating application. It is very awkward and wasteful to use big flat paint trays or paint cans, because carrying the paint filled tray or can with wet applicators from place to place during coating operation is hazardous, since an open topped tray/can with applicators is clumsy and easy to spill and drop.

When the coating operation is temporarily suspended, the roller/brush, must be thoroughly cleaned and dried until the coating operation is proceeded. The paint also must be poured into the clumsy paint can or paint tray which is very time consuming and messy.

There is an inevitable loss of paint from the applicators and tray, during such cleaning operations, on the other hand, if it is left unattended and uncleaned, the paint will harden on the roller or brushes making replacement of the applicators very costly.

Many Asian people, spread sesame oil on the fine, delicate seaweeds with fingers, feathers or brushes. The current method is a slow process and also tears up the thin seaweeds. Since the oil is impossible to wash from the brush or feathers, rancid oil residue remains on the brush/feather, which will transfer the rancid oil to seaweeds for the next application.

Accordingly, there remains a need for an improved liquid coating dispenser with applicator that is able to solve all the above prior/existing problems.

SUMMARY OF THE INVENTION

The applicator and dispenser kit of the present invention satisfies all the foregoing needs. The kit is substantially set forth in the Abstract. Thus, the kit includes an applicator and dispenser. The applicator is comprised of two different sized rollers, one being small and the other approximately double in size, they are both generally olive shaped. The rollers are comprised of a roller cover and spindle. The roller cover can be made of ceramic, metal, wood, rubber, fabric, natural or synthetic sponge; in this case the applicant is using a sponge, as an example. Each sponge has only one opening to accommodate the spindle, the spindle has only one opening to accommodate the rod. The size and the shape of the inner sponge is the same as the outer shape and size of the spindle, which rolls freely. The front end of the rod is in the shape of a bulb, which is split down its center to allow the spring action, which enables it to be retained in the spindle and to be snapped on and off. The two rods are connected together at the rear end of their handles, which is part of the rod, by a maneuverable and detachable hinge which will allow the applicator to bend for the purpose of storing the applicator within the dispenser, and to straighten it when in use.

The dispenser has a generally rectangular appearance from a general view, and in side elevation, the dispenser has a "V" shaped appearance without the handles; one vertical and the other horizontal.

The dispenser has a main internal shelf for storing/resting the applicators, and additional mini-shelves for supporting extra applicators above the well while the other applicator is in use; this procedure, is also helpful in preventing applicators from being over-saturated.

A downwardly sloped internal ramp, which has a corrugated surface, which serves as a wiper grid, will remove excess liquid from the applicators. An optional screen can be laid on the internal ramp for extra fast removal for excessive liquid. The rollers can be both stored in the well, or one on the shelf, and one in the well. The container and wiper grid preferably are made of glass, ceramic, plastic, wood, hard rubber, metal or any suitable material. The spindles and rod/handle are made of metal, hard rubber, wood, or plastic.

The kit is useful for applying make-up, paint touch up, art related projects and spreading oil or adhesives, etc.

Depending on the task, the size of the dispenser and rollers may differ: fatter, thicker, longer or larger.

The kit is simple, efficient, durable and inexpensive. Further features of the kit are set forth in the following detailed description and accompanying drawings.

DRAWINGS

FIG. 1: is a schematic cross-section side view of the first preferred embodiment of the rollers and dispenser;

FIG. 2: is a schematic rear perspective view of the first preferred embodiment of the dispenser;

FIG. 3: is a schematic perspective side elevation of the applicator of FIG. 1, in its open position;

FIG. 4: is a schematic side elevation of the second preferred embodiment of the container with applicator;

FIG. 5: is an enlarged schematic cross-section of the larger of the two sponges of FIG. 3, and its means of connection to its rod;

FIG. 6: is an enlarged schematic cross-section of the spindle;

FIG. 7: is a schematic perspective view of the second preferred embodiment of the dispenser;

FIG. 8: is an enlarged schematic cross-section of the larger of the two spindles.

FIG. 9: is a schematic perspective view of the third preferred embodiment of the container.

FIG. 10: is a schematic front view of the container, section view of FIG. 9.

DETAILED DESCRIPTION

Figure 5:
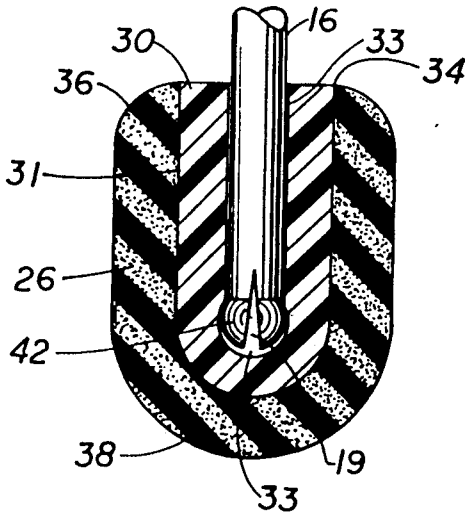

Referring more particularly to FIGS. 1, 2, 3, 5, 6 and 8, the first embodiment of the present invention is schematically depicted therein kit 10 is shown, which comprises applicator 12, releasably disposed in a dispenser 14. Applicator 12 comprises of a pair of elongated straight rods 16 and 18 having wider handles 20 and 22, respectively at the rear end thereof releasably secured together by a hinge 24 so that rods 16 and 18 can bend between the stored position of FIG. 1 and, the straight operative position of FIG. 3. Spindles 30 and 32 are attached respectively and rotationally to rods 16 and 18. Sponges 26 and 28 are bonded respectively to spindles 30 and 32 to as is depicted in cross-section FIG. 5. Sponges 26 and 28 are generally oval, oliveshaped with open rear end 36/38 that are fabricated of natural or synthetic sponge and smooth surfaced. The open rear end cavity of the sponge 34 is to receive spindle 30, which is the same size and shape as outer spindle portion 31. The internal tip of the spindle 33 is a bulbous shape which will retain the split, bulbous shaped rod end 42. Split 19 compresses during insertion into spindle 30, while fully residing within internal tip 33, split 19 opens to prevent the spindle from falling off the rod (FIG. 5). Unless physically removed, spindle 30 is fixed to rod 16 and rotates freely around rod 16. Applicator 12 can be held in the hand by handle 20 and easily manipulated and is light in weight and touch, faster in action when applying cosmetics, especially liquid foundation, to the skin than other methods and provides a smoother, more uniform result.

The rollers can be dipped or rolled into the liquid and then rolled upon the grid 54, which has a rough surface to remove excess liquid or cream cosmetic. Then the roller can be rolled onto the skin by sponge 26. Cosmetics can be applied evenly by roller, either in thick or thin layers without caking or forming wrinkle lines, the result is very natural. The sponge 28 being identical to sponge 26 in construction, shape and use, differing only in size. The smaller sponge 28 is especially beneficial for hard to reach areas, for example, around the nose and eyes. Messy hands are avoided and rollers can easily be removed and cleaned in warm soapy water for re-use.

Figure 1:
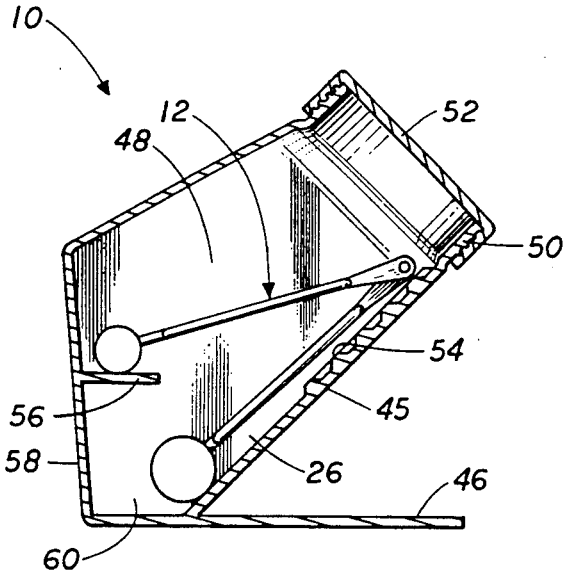
Figure 2:
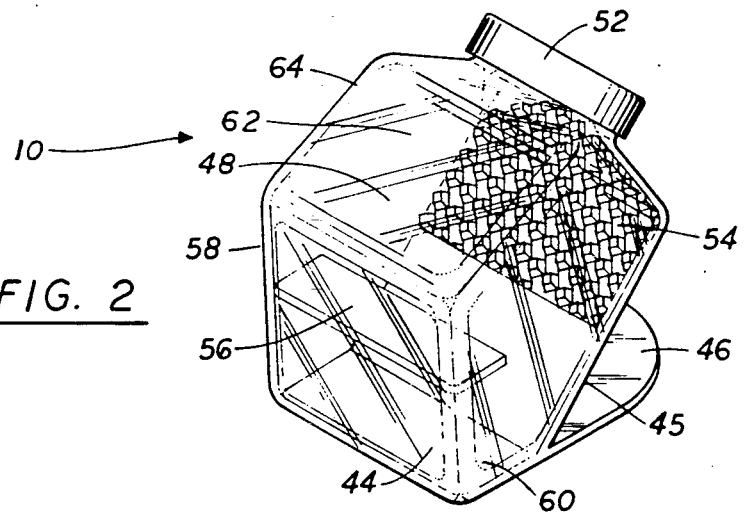
Figure 3:
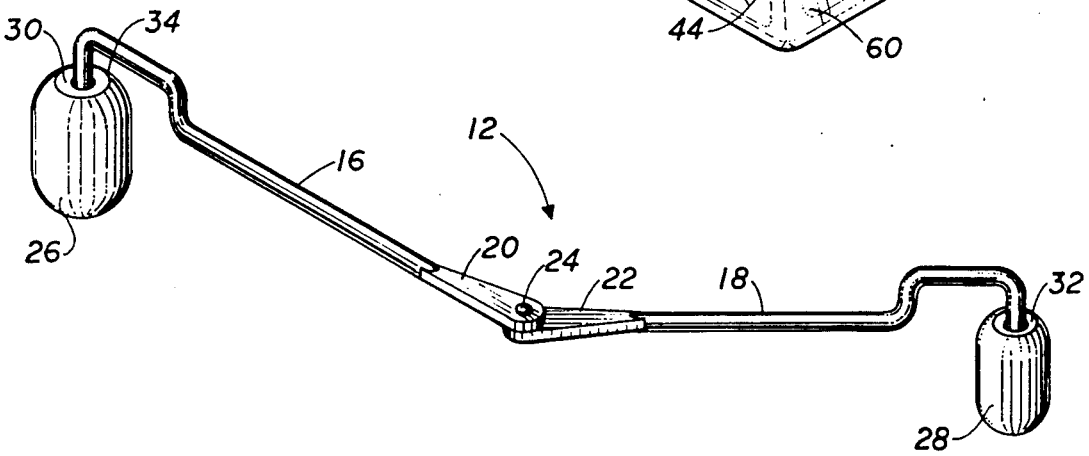

Dispenser 14 is useful in kit 10 to store liquid or cream cosmetic 44 against evaporation and also to store applicator 12 (see FIG. 1). In this regard, dispenser 14 comprises a flat horizontal base 46 having an upper exterior surface integrally connected to the back end panel 58 which is connected to upper panel 62. Upper panel 62 is connected to side panels 64 which are both connected to "V" shaped upper panel (ramp) 45. Upper panel 45 is connected to lower base 46, to comprise a generally "V" shaped in a side view. Applicator storage portion 48 has a downwardly sloping ramp or roller grid 54 fabricated from a sheet of plastic screen a plate with a roughened surface or the like so that sponge 26 and 28 can be rolled thereon. The grid 54 slopes down towards a bottom well 60 and rises at an angle up towards a front opening 50, over which a removable lid 52, threaded or snap-on, can be secured. Portion 48 also has an upper horizontal shelf 56 for applicator storage, preventing oversaturation of the roller by cosmetic/liquid 44.

As shown in FIG. 1, applicator 12 can be folded so that one of the sponges 26 or 28 rests on the shelf 56 while the other rests in well 60 (FIG. 1), while entire applicator 12 is in container 14, with the lid 52 in place to prevent evaporation or contamination of cosmetic/-liquid 44 (FIG. 1).

Figure 4:
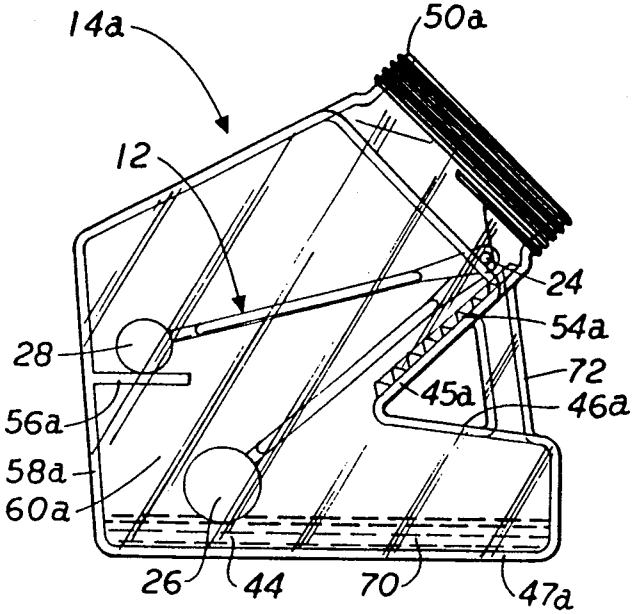
Figure 6:
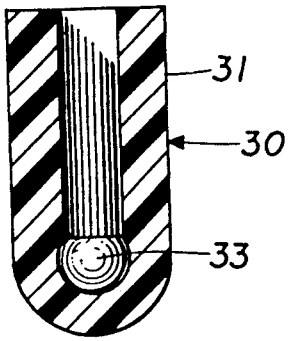
Figure 7:
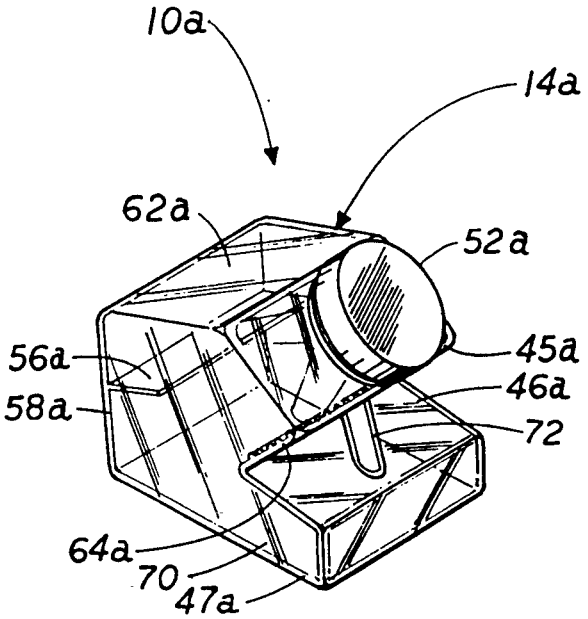
Figure 8:
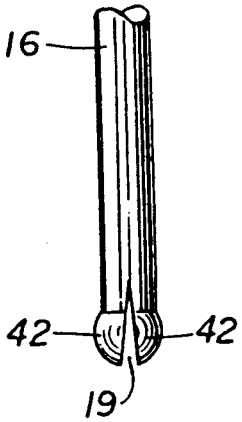

A second preferred embodiment of the dispenser is schematically depicted in FIGS. 4 & 7. Dispenser **14*a* is shown. Dispenser 14*a* is similar to dispenser 14 and bears the same numerals but is succeeded by the letter "a". Dispenser 14*a* is identical to dispenser 14** except as follows:

a) between the exterior surfaces of panels **46*a* and 47*a* is a hollow area so as to form a reservoir 70 for extra liquid 44*a*. Reservoir 70 forms part of well 60*a* below grid 54*a*; and, b) vertical carrying handle 72 is provided between upper panel 45*a* and lower panel 46*a***, the two panels defining a generally "V" shape.

Figure 9:
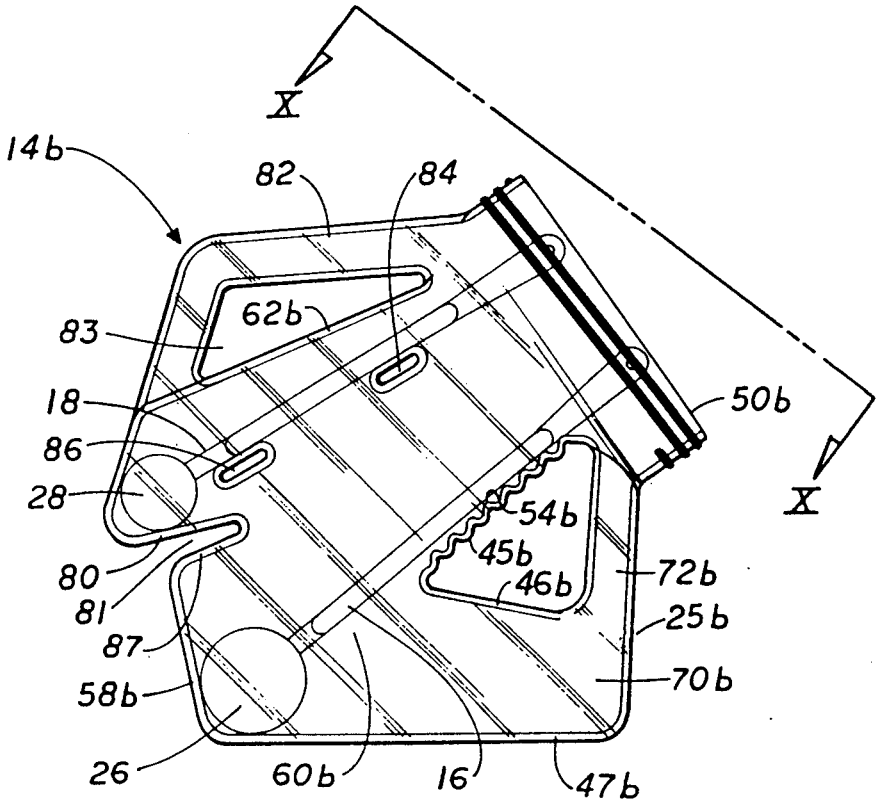
Figure 10:
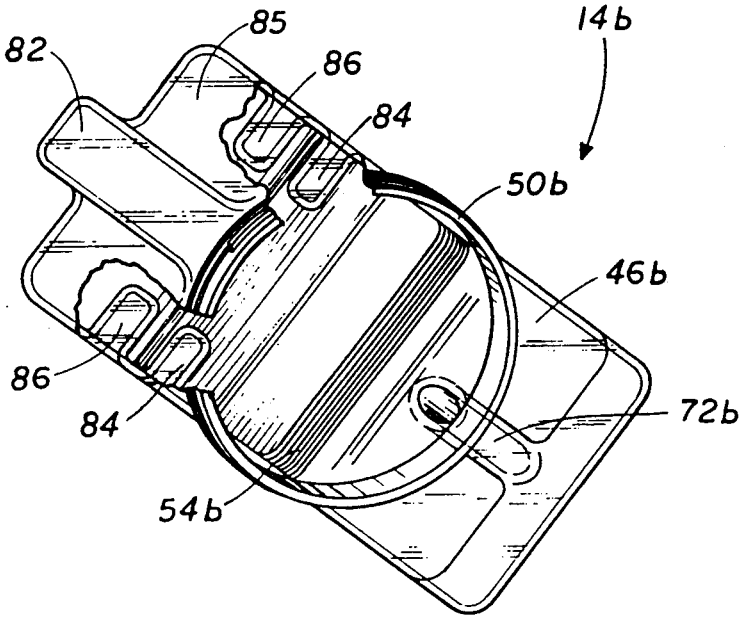

A third preferred embodiment of the kit **10*b* of the present invention is schematically depicted in FIGS. 9 and 10. Container 14*b* is shown. Components thereof are similar to dispenser 14*a*** and bear the same numerals, but are succeeded by the letter "b", except the new numerals, as follows:

a) an extra horizontal bar handle 82 is attached on upper panel **62*b*** of the dispenser to enable horizontal carrying;

b) the dispenser has mini-shelves 86 and 84, which are attached from side panels that are above the well and shelf **56*a* to hold the surplus applicators, while the main applicator is in use (FIG. 9). c) a U-shape internal shelf is part of the back end panel 58*b* and made of upper arm 80 and lower arm 87 and produces space 81. This design will make blow molding easier (FIG. 9**).

d) handle **72*b* is hollow so excess liquid from the grid can drip through the handle and return to reservoir 70*b***.

The applicator and dispenser kit of the present invention is compact, efficient, inexpensive and durable. It is of novel configuration and utility.

Various other modifications, changes, alterations and additions can be made to the applicator and dispenser kit of the present invention, its components and parameters. All such changes, modifications, alterations and additions as are within the scope of the appended claims form part of the present invention.

What is claimed is:

1. A dispenser having a flat, horizontal lower base and a bottom well, and an applicator storage portion comprised of at least a portion of the bottom well, the applicator storage portion defined by a portion of said lower base, a back end panel, an upper panel, two opposing side panels and a sloped panel opposite said back end panel, said sloped panel defining, with an adjacent exterior surface of the dispenser, a generally "V" shape in side elevation, said applicator storage portion having an opening and a lid therefor located at an upper end of the applicator storage portion, the applicator storage portion including therein a grid located on the interior of said sloped panel, said grid extending down towards the bottom well, the applicator storage portion further including an upper interior shelf extending from said back end panel for resting an applicator above said bottom well, said grid having a rough surface.

2. The dispenser of claim 1 wherein said sloped panel and said adjacent exterior surfaces are connected by a vertical carrying handle.

3. The dispenser of claim 2 wherein said handle is hollow, allowing liquid to pass there through to said bottom well.

* * * * *